United States Patent [19]

Sember, III

[11] Patent Number: 4,915,124

[45] Date of Patent: Apr. 10, 1990

[54] BLADDER PRESSURE CONTROL SYSTEM AND METHOD

[75] Inventor: Joseph A. Sember, III, Glendale, Calif.

[73] Assignee: Jasco Products, Inc., Glendale, Calif.

[21] Appl. No.: 175,069

[22] Filed: Mar. 30, 1988

[51] Int. Cl.[4] ..... F16K 15/20; A47C 27/10

[52] U.S. Cl. ..... 137/223; 137/883; 5/453; 5/456; 297/DIG. 3; 200/61.58 R

[58] Field of Search ..... 137/223, 883; 5/453, 5/456, 455; 297/DIG. 3; 200/52 R, 61.58 R, 401

[56] References Cited

U.S. PATENT DOCUMENTS

| | | | |
|---|---|---|---|
| 2,136,510 | 11/1938 | Jensen | 137/223 X |
| 3,166,799 | 1/1965 | Birnkrant | 5/453 X |
| 3,192,540 | 7/1965 | Swank | 137/223 X |
| 3,192,541 | 7/1965 | Moore | 137/223 X |
| 3,303,518 | 2/1967 | Ingram | 5/456 |
| 3,363,941 | 1/1968 | Wierwille | 5/456 X |
| 3,426,373 | 2/1969 | Scott et al. | 5/456 |
| 3,485,240 | 12/1969 | Fountain | 5/456 X |
| 4,175,297 | 11/1979 | Robbins et al. | 5/453 X |
| 4,190,286 | 2/1980 | Bentley | 5/455 X |
| 4,550,750 | 11/1985 | Korth | 137/883 X |
| 4,552,402 | 11/1985 | Huber et al. | 5/456 X |
| 4,597,723 | 7/1986 | Sember et al. | 137/883 X |
| 4,619,481 | 10/1986 | Grudzinskas | 137/883 X |
| 4,633,763 | 1/1987 | Manning et al. | 137/883 |

*Primary Examiner*—John Rivell

*Attorney, Agent, or Firm*—Lynn & Lynn

[57] ABSTRACT

A multiple inflatable/deflatable seat cushion bladder system has bladders arranged to receive pressurized air from one source without having fluid communication between the separate bladders when they are deflated or when an external load increases the pressure in one of the bladders. Input tubes are connected to the bladders and an inflation valve is connected to the input tubes for permitting fluid flow into the bladders while preventing fluid flow out of each of the bladders. An output tube is connected to the each bladder, and a deflation valve is connected to the output tubes for permitting fluid flow out of each bladder while preventing cross flow between the bladders. A switch assembly connected to the inflation valve and to the deflation valve allows the pressure in the bladders to remain constant or to be selectively increased or decreased.

2 Claims, 3 Drawing Sheets

BLADDER PRESSURE CONTROL SYSTEM AND METHOD

BACKGROUND OF THE INVENTION

This invention relates generally to pneumatically powered mechanisms and particularly to pneumatically powered mechanisms for use in seat cushions suitable for use in chairs and vehicle and airplane seats. Still more particularly, this invention relates to mechanisms for controlling the fluid pressure in a seat cushion or seat bolster bladder system.

Various types of inflatable seat and cushion constructions are currently employed to provide comfortable support for various sections of the body such as the lower back. To vary the amount of support to the lower back or to other parts of the seat occupant's body, inflatable/deflatable bladders are placed externally to the resilient foam of the cushion and connected to a manually operated pump and vent valve system or to an electric powered compressor and an electropneumatic switch assembly/valve system. Such bladders may have one or more chambers that may be selectively inflated or deflated.

Many modern automobile seats have side bolsters that include inflatable/deflatable bladders. These side bolsters may be arranged to fit against the hips or shoulders of a person sitting in the seat. The side bolsters prevent the seat occupant from sliding laterally when the automobile turns a corner or goes around a curve. Previous inflatable bladder arrangement for have allowed fluid communication between the bladders on opposite sides of the seat. Therefore, if the seat occupant exerts a force on the left shoulder bolster, for example, the resulting pressure differential causes gas to flow from the left bolster bladder to the right bolster bladder. This gas flow is undesirable in seats designed for applications where firm support is required.

SUMMARY OF THE INVENTION

The present invention provides a multiple inflatable-deflatable bladder system in which the bladders receive air from one pump with controllable fluid communication between the separate bladders.

A system according to the present invention includes at least a pair of bladders configured for mounting in a seat cushion. An input tube is connected to a each of the bladders. An inflation valve is connected to each input tube for permitting fluid flow into the bladders while preventing fluid flow out of the bladders. An output tube is connected to each bladder, and a deflation valve is connected to each output tube for permitting fluid flow out of each bladder while preventing cross flow between the bladders. A switch assembly is connected to the inflation valve and to the deflation valve. The switch assembly includes a switch that is biased to be in a neutral state in which no fluid flows to or from any of the bladders. The switch also includes means for being actuated between a first switching state for supplying fluid to the bladders through the input tubes and a second state for removing fluid from the bladders through the output tubes.

The inflation valve may comprise a check valve connected to each input tube to permit fluid flow toward each bladder while preventing fluid flow out of each bladder. The deflation valve may comprise a check valve connected to each output tube to permit fluid flow out of each bladder while preventing cross flow between the bladders. The switch assembly may comprise an electropneumatic switch.

In a second embodiment of the invention, the inflation valve may comprise a first solenoid valve assembly that includes a solenoid valve connected to each input tube to permit fluid flow into each bladder while preventing fluid flow out of each bladder. The deflation valve may comprise a second solenoid valve assembly that includes a solenoid valve connected to each output tube to permit fluid flow out of each bladder while preventing cross flow between the bladders. The switch assembly may comprise an electrical double pole, double throw switch.

The present invention also includes a method for controlling fluid pressure in an inflatable/deflatable seat bladder system that includes at least a pair of bladders configured for mounting in a seat cushion. The method according to the present invention includes the steps of: connecting a first input tube to a first one of the bladders; connecting a second input tube to a second one of the bladders; permitting fluid flow into the bladders from the first and second input tubes while preventing fluid flow out of each of the bladders; connecting a first output tube to the first bladder; connecting a second output tube to the second bladder; and permitting fluid flow out of each bladder while preventing cross flow between the bladders.

DESCRIPTION OF THE PREFERRED EMBODIMENT

Figure 1:
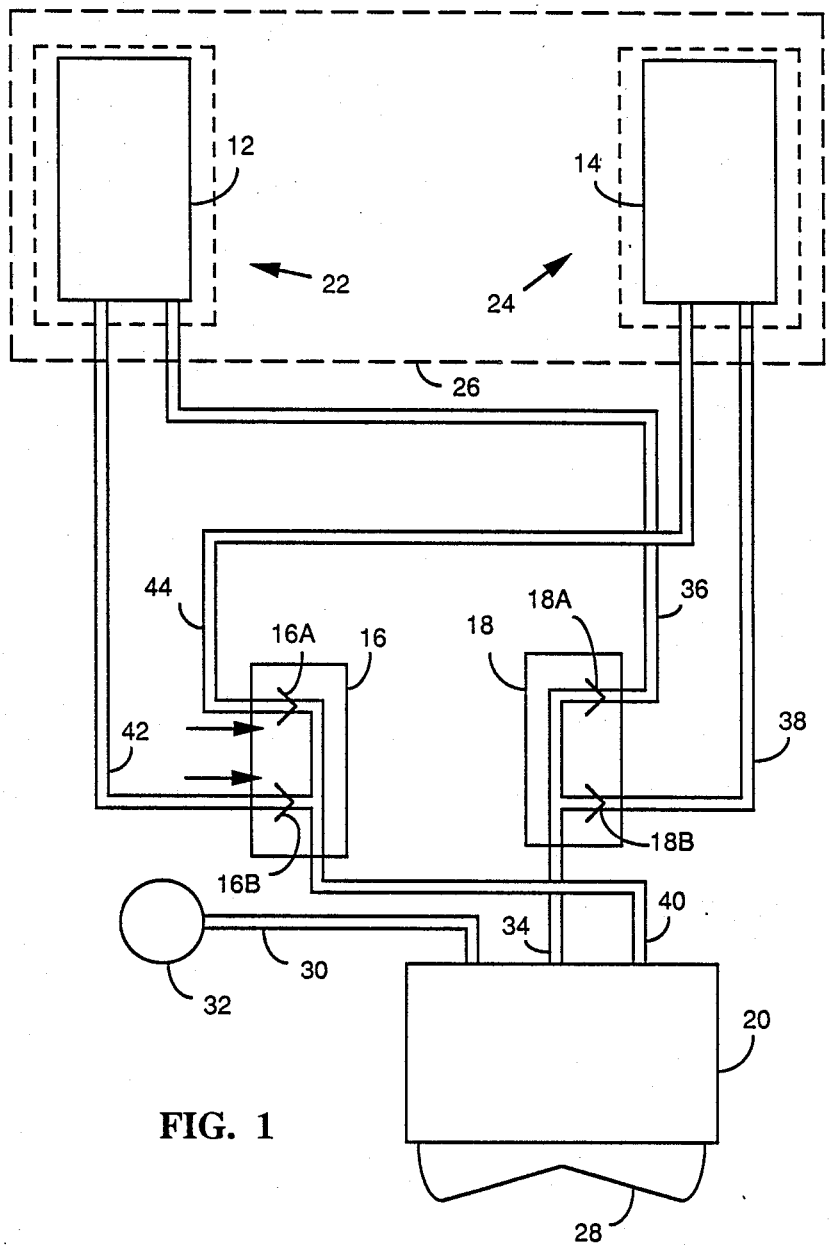
FIG. 1 shows a pneumatically operated seat bladder system according to the present invention.

Referring to FIG. 1, a seat bladder control system 10 according to the invention includes a pair of bladders 12 and 14, a pair of check valve blocks 16 and 18 and a switch assembly 20. The bladders 12 and 14 may be mounted in the right and left shoulder bolsters 22 and 24, respectively, of a seatback 26.

The switch assembly 20 preferably includes a rocker switch 28 that is biased to remain in a neutral position while being movable between an inflation position and a deflation position. While the rocker switch 28 is in its neutral position, no gas flows to or from the bladders 12 and 14.

A gas supply tube 30 connected to the switch assembly 20 supplies a pressurized gas such as air from a pump 32 or a reservoir (not shown) arranged to accumulate a suitable pressurized gas. A tube 34 is connected between the switch assembly and the check valve block 18. The check valve block 18 includes a pair of check valves 18A and 18B that are connected to the bladders 12 and 14, respectively, via air input tubes 36 and 38. When the rocker switch 28 is moved to the inflation position, pressurized air from the pump 32 enters the tube 34. The check valves 18A and 18B manifold the path from the pump to the bladders 12 and 14. Therefore, pressurized air from the pump 32 is placed in fluid communication with the bladders 12 and 14 to inflate them when the rocker switch 28 is moved to the inflation position.

As shown in FIG. 1, when the rocker switch 28 is moved to the inflation position, both bladders 12 and 14 are inflated equally. When the bladders 12 and 14 are inflated to the desired pressure, the rocker switch 28 is allowed to return to its neutral position. Allowing the rocker switch 28 to move to its neutral position, de-energizes the pump 32 and closes the fluid path between the pump 32 and the tube 34.

The check valves 18A and 18B prevent any reverse gas flow from the bladders 12 and 14 to the switch assembly 20. The check valves 18A and 18B also do not permit cross flow between the bladders 12 and 14.

A deflation tube 40 is connected between the switch assembly 20 and the check valve block 16, which contains a pair of check valves 16A and 16B. A pair of air output tubes 42 and 44 are connected between the check valves 16A and 16B, respectively and the bladders 12 and 14. The check valves 16A and 16B are arranged to place the bladders 12 and 14, respectively, in fluid communication with the deflation tube 40 so that air can flow from the bladders 12 and 14 into the deflation tube. However, the check valves 16A and 16B do not permit cross flow between the bladders 12 and 14. When the rocker switch 28 is moved to the deflation position, a valve in the switch assembly opens and air is allowed to escape from the deflation tube 40 to the atmosphere, thereby deflating the bladders 12 and 14. When the desired amount of air has escaped from the bladders 12 and 14, the rocker switch 28 is again allowed to resume its neutral position.

Figure 5:
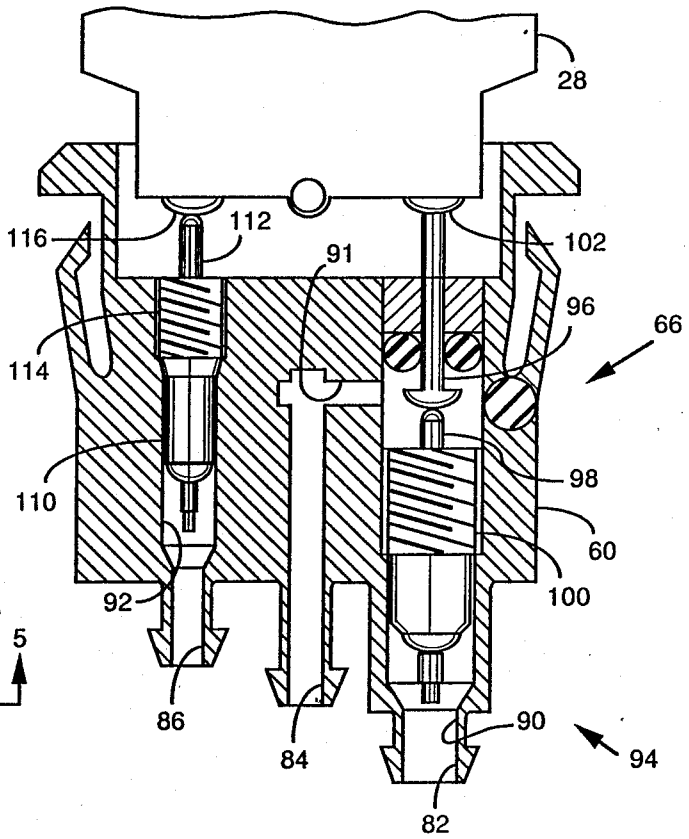
FIG. 5 is a cross sectional view of the switch of FIG. 3 taken along line 5—5.
Figure 3:
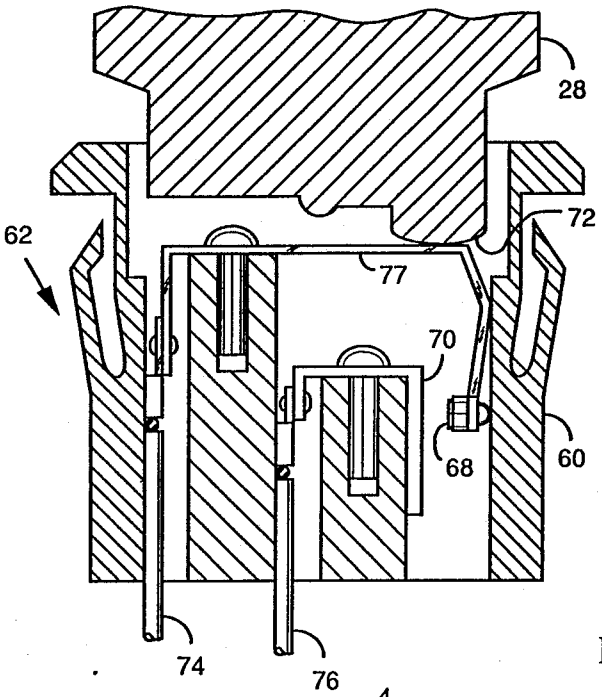
FIG. 3 illustrates an electropneumatic switch assembly that may be included in the invention as illustrated in FIG. 1.
Figure 4:
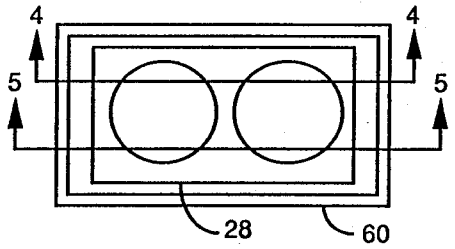
FIG. 4 is a cross sectional view of the switch of FIG. 3 taken along line 4—4.

FIGS. 3–5 illustrate the switch assembly 20 in greater detail than FIG. 1. Referring to FIGS. 3–5, the switch assembly 20 includes a housing 60 in which the rocker switch 28 is pivotally mounted. The switch assembly 20 includes an electric switch 62 as shown in FIG. 4 for activating the pump 32 and a pneumatic switch 66, as shown in FIG. 5, for controlling whether air flows into or out of the bladders 12 and 14.

Referring to FIG. 4, the electrical switch 62 includes a pair of switch contacts 68 and 70 and a projection 72 that extends from the rocker switch 28. Electrical conductors 74 and 76, respectively, are connected to the switch contacts 68 and 70, the pump 32 and an electrical power source (not shown). The switch contacts 68 is mounted on a spring 77 that prevents inadvertent contact between the switch contacts 68 and 70. The switch contacts 68 and 70 are normally open so that the pump 32 is normally off. Clockwise rotation of the rocker switch 28 as viewed in FIG. 4 brings the switch contact 68 and 70 together to complete the circuit and activate the pump 32.

Referring to FIG. 5, the pneumatic switch 66 includes a pressure input port 82, a pressure output port 84 and a vent port 86 in the housing 60 The input tube 30 of FIG. 1 is connected to the pressure input port 82, and the tubes 34 and 40 are connected to the pressure output port 84 and the vent port 86, respectively. The pressure input port 82 and the pressure output port 84 are connected via passages 90–92 in the housing 60.

A valve assembly 94 is mounted in the passage 90 to control fluid flow between the passages 90 and 91. The valve assembly 94 includes a pair of plungers 96 and 98 and a valve body 99 mounted by threads 100 in the passage 90. The plungers 96 and 98 are placed end to end with one end of the plunger 96 being in contact with a projection 102 that extends from the rocker switch 28. The valve 94 preferably is a schrader valve assembly having an internal spring (not shown) that biases the plungers 96 and 98 so that the plunger 96 bears against the projection 102. Clockwise rotation of the rocker switch 28 as viewed in FIGS. 4 and 5 depresses the plungers 96 and 98 against the bias of the spring in the valve 94. When the rocker switch 28 is rotated a sufficient amount in the clockwise direction, the valve 94 opens and the pump 32 is activated to force air through the passages 90 and 91 into the tube 34 and thence to the bladders 12 and 14.

A valve 110 is mounted in the passage 92 to control the venting of the bladders 12 and 14 to the atmosphere. The valve 110 is similar to the valve 94 and includes a spring (not shown) which urges a plunger 112 against a projection 116 that extends from the rocker switch 28. Counterclockwise rotation of the rocker switch 28 as viewed in FIGS. 4 and 5 opens the valve 110 while the valve 94 remains closed. The bladders 12 and 14 then vent to the atmosphere until the rocker switch 28 is allowed to rotate away from the deflation position.

The springs in the schrader valves 94 and 110 are arranged so that the rocker switch 28 is normally in the neutral position with both valves 94 and 110 being closed.

Figure 2:
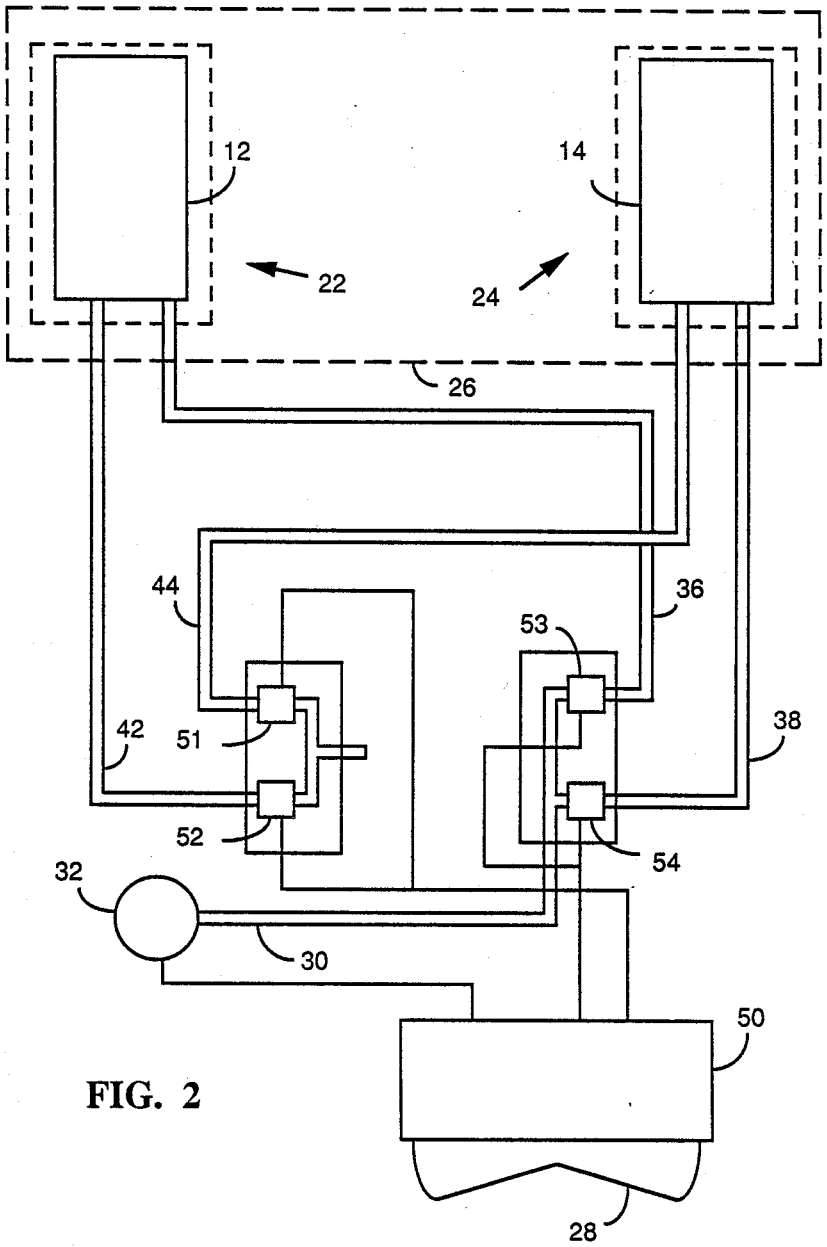
FIG. 2 illustrates a second embodiment of the invention.

FIG. 2 shows a second embodiment of the invention that includes a double pole, double throw electric switch 50 instead of the switch assembly 20 and solenoid valves 51–54 instead of the check valves 16A, 16B, 18A and 18B, respectively. This second embodiment functions in essentially the same manner as the embodiment of the invention described above with reference to FIG. 1.

When the switch 50 is in a neutral position, all the solenoid valves 51–54 are closed. Moving the switch to its inflation setting activates the pump 32 and opens the valves 53 and 54 while leaving the valves 51 and 52 closed. Air then enters the bladders 12 and 14.

When the switch is in its deflation setting, the valves 51 and 52 are open, the valves 53 and 54 are closed, and the pump is off. The bladders 12 and 14 are then vented to the atmosphere.

The present invention has been described with reference to specific preferred embodiments. Persons skilled in the relevant art may make variations to these preferred embodiments without departing from the spirit of the invention. Therefore, the present invention includes the subject matter defined by the appended claims and all reasonable equivalents.

What is claimed is:

1. A control system for an inflatable/deflatable seat bladder system that includes at least a pair of bladders configured for mounting in a seat cushion comprising:

a source of pressurized fluid;

a first input tube connected to a first one of the bladders;

a second input tube connected to a second one of the bladders;

an inflation valve for permitting fluid flow into the first and second bladders from the first and second input tubes while preventing fluid flow out of each of the bladders;

a first output tube connected to the first bladder;

a second output tube connected to the second bladder;

a deflation valve for permitting fluid flow out of each bladder while preventing cross flow between the bladders; and a switch assembly connected to the source of pressurized fluid, the inflation valve means and to the deflation valve means, the switch assembly including a rocker switch that is biased to be in a neutral position in which no fluid flow to or from any of the bladders, the rocker switch being rotatable in a first direction from the neutral position to a first switching position wherein fluid is supplied from the source of pressurized fluid to the bladders through the input tubes, the rocker switch being rotatable in a second direction from the neutral position to a second switching position wherein fluid flows from the bladders through the output tubes.

2. The control system of claim 1, further comprising:

a pair of electrical switch contacts that are normally open;

a pump connected to one of the electrical switch contacts;

means extending from the rocker switch for closing the pair of switch contacts when the rocker switch is rotated to the first switching state to activate the pump to supply pressurized fluid to the bladders;

a first projection extending from the rocker switch for opening the inflation valve when the rocker switch is rotated to the first switching state to allow fluid from the pump to enter the bladders; and a second projection extending from the rocker switch for opening the deflation valve when the rocker switch is rotated to the second switching state to allow fluid flow from the bladders to the output tubes.

* * * * *